US005344037A

United States Patent [19]

Favre

[11] Patent Number: 5,344,037

[45] Date of Patent: Sep. 6, 1994

[54] CASE WITH ARTICULATED COVER URGED TO OPEN POSITION

[75] Inventor: Bernard Favre, Chevilly-Larue, France

[73] Assignee: LIR France, Chevilly-Larue, France

[21] Appl. No.: 49,702

[22] Filed: Apr. 20, 1993

[30] Foreign Application Priority Data

May 15, 1992 [FR] France ..... 92 05932
Dec. 11, 1992 [FR] France ..... 92 14942

[51] Int. Cl.[5] ..... B65D 42/26; A45C 13/34
[52] U.S. Cl. ..... 220/264; 132/293
[58] Field of Search ..... 220/263, 264, 281, 282, 220/283; 132/293, 294, 295, 315

[56] References Cited

U.S. PATENT DOCUMENTS 4,930,528 6/1990 Hatakeyama ..... 132/301
5,107,984 4/1992 Welschoff .

FOREIGN PATENT DOCUMENTS 0053872 6/1982 European Pat. Off. .
2420406 11/1974 Fed. Rep. of Germany .
2137594 10/1984 United Kingdom .
2140392 11/1984 United Kingdom .
2187787 9/1987 United Kingdom .

*Primary Examiner*—Allan N. Shoap
*Assistant Examiner*—Nova Stucker
*Attorney, Agent, or Firm*—Young & Thompson

[57] ABSTRACT

A case, particularly for cosmetic products, of the type comprising a base (1), a cover (2) articulated on an edge of the base (1), a catch (4, 5) for the cover (2) and the base (1) on the edge opposite the articulation (3), and a thumb piece (6) for freeing the catch (4, 5). A block (13) is elastically buttressed between the base (1) and the cover (2) and disposed so as to be prestressed during closing of the cover (2).

4 Claims, 2 Drawing Sheets

CASE WITH ARTICULATED COVER URGED TO OPEN POSITION

FIELD OF THE INVENTION

The invention relates to a case, in particular for cosmetic products, of the type comprising a base, a cover articulated on an edge of said base, catch means for the cover and base on the edge opposite the articulation, and a thumb piece for freeing said catch means.

BACKGROUND OF THE INVENTION

In known cases of this type, action on the thumb piece permits unlocking the catch means but the cover remains practically closed on the base, so that the user must open it, for example by inserting a fingernail in the free space between the base and the cover. Moreover, the cover tends to return to closed position by gravity, which militates against a reasonable use of the case.

To overcome this drawback, it is known to provide a return spring, for example a helicoidal spring wound about the articulation axle and whose ends bear respectively on the base and the cover. The mounting of such a spring is complicated and difficult for cases of small dimensions such as compacts. Moreover, the return force is difficult to calibrate so as not to trigger a too abrupt and/or too complete opening. Moreover, such a system is difficultly adaptable to cases comprising an internal platform which must also be articulated on the base and open to give access to a product to be used such as a cake of face powder.

SUMMARY OF THE INVENTION

The present invention has for its object to provide a new case of the preceding type in which the opening of the cover, and if desired an internal platform, will be facilitated by simple, effective means easy to provide.

To this end, the case according to the invention is characterized in that it comprises a block elastically buttressed between the base and the cover and disposed so as to be prestressed during closing of the cover.

According to an embodiment of the invention, said block is elastically deformable, for example of rubber.

According to a modification of the invention, said block is integral with the cover to which it is connected by an elastically deformable curved arm, which reduces the fatigue for preopening of the cover for example less than or equal to 15%.

According to a particularly preferred embodiment of the invention, the case contains a platform whose edge adjacent said articulation of the cover and of the base is embedded in said block.

BRIEF DESCRIPTION OF THE DRAWINGS

The invention will be understood from a reading of the following description given with reference to the accompanying drawing, in which.

DETAILED DESCRIPTION OF THE INVENTION

Figure 1:
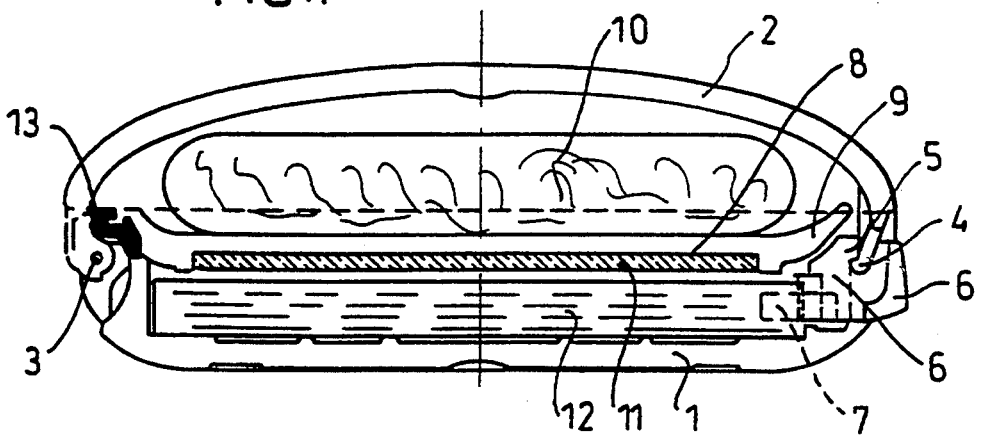
FIG. 1 is a schematic cross sectional view of a case according to an embodiment of the invention.
Figure 2:
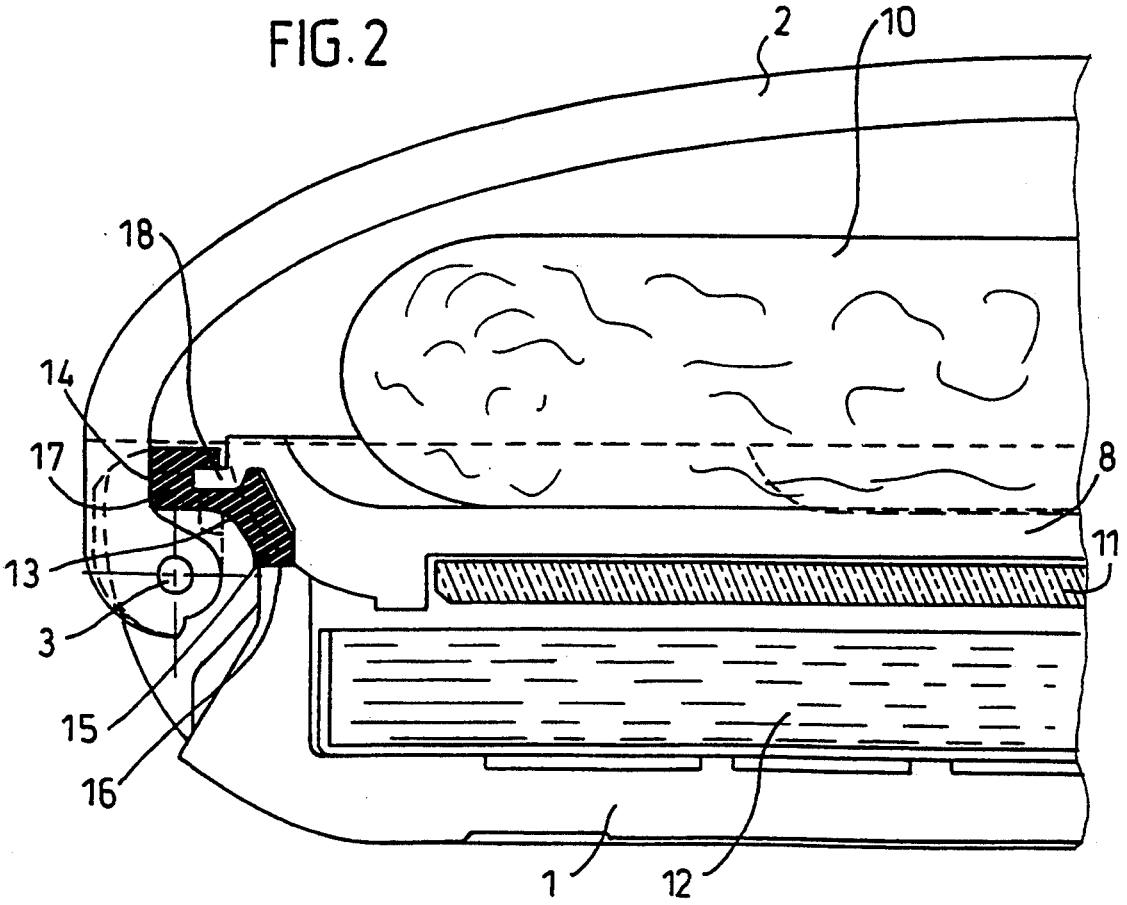
FIG. 2 is a schematic view on a larger scale of the articulation of the case of FIG. 1.

In FIGS. 1 and 2, the case comprises a base 1 on which is articulated a cover 2 about an axle 3. Opposite the articulation axle 3, the cover 2 is provided with a hook 4 with which coacts a nose 5 of a thumb piece 6 urged by spring 7.

Within the case 1, 2 is disposed a platform 8. A sponge 10 or a powder puff is disposed above the platform 8 whose surface turned toward base 1 bears a mirror 11. One or several compressed powder cakes 12 is disposed within the base 1.

With the known assembly which has been described, the pushing in of the thumb piece 6 against the action of its return spring 7 produces effectively the liberation of hook 4 of the cover 2 but, if the user releases the thumb piece 6, its nose 5 snaps again over the hook 4. The user must simultaneously keep the thumb piece 6 pressed and raise the cover 2 effectively to open the case.

To overcome this drawback, the present invention provides an elastically deformable block 13, preferably of rubber, whose one end 14 bears against the interior of cover 2 adjacent the axle 3 and whose other end 15 bears against an abutment 16 on the base 1. The arrangement is such that, in the closed position shown, the block 13 is compressed or precompressed such that, as soon as the hook 4 has been freed by pushing in the thumb piece 6, the block 13 extends and causes the cover 2 to pivot about the axle 3 in a counterclockwise direction (on the drawing).

The block 13 comprises a recess 17 in which is disposed a projection 18 of the platform 8. In the course of extension of the block 13, the platform 8 is also driven in rotation in the same direction as the cover 2, thereby giving access to the mirror 11 and the powder 12.

Figure 3:
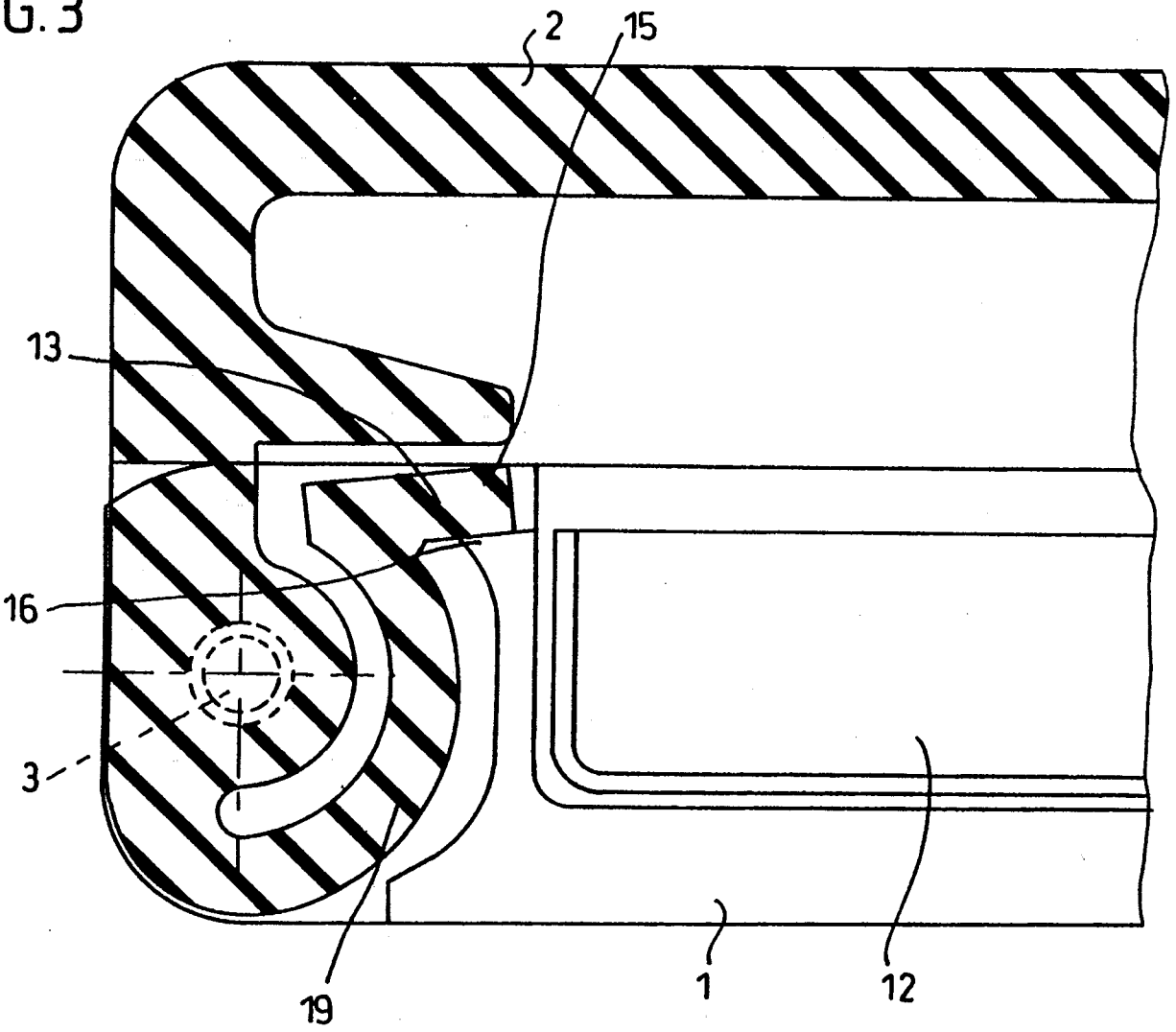
FIG. 3 is a schematic cross sectional view of the articulation portion of a case according to a modification of the invention.

In a modification shown schematically in FIG. 3, the block 13 is of a single piece with the cover 2, to which it is connected by an elastically deformable arm 19 of relatively great length, of curved shape, which extends about the articulation axle 3 of the cover 2 on the base 1. This embodiment of the invention permits obtaining a limited opening of the cover 2, for example less than or equal to 15° without loss of elastic memory due to flow with time which can happen with a rubber block or the like. The arm 19 operates solely in torsion with little fatigue. This embodiment is moreover more economical because the block 13, the arm 19 and the cover 2 are molded of a single piece.

What is claimed is:

1. A case comprising a base (1), a cover (2) hinged on an edge of said base (1) at an articulation (3), catch means (4, 5) for latching the cover (2) and the base (1) on an edge opposite the articulation (3), a thumb piece (6) for freeing said catch means (4, 5), an elastically deformable block (13) buttressed between the base (1) and the cover (2) and disposed adjacent to and abutting the articulation so as to be prestressed during closing of the cover (2), and a platform (8) having an edge adjacent said articulation (3) of the cover (2) and the base (1), said adjacent edge being embedded in said block (13).

2. A case according to claim 1, wherein said block (13) is of rubber.

3. A case comprising a base (1), a cover (2) hinged on an edge of said base (1) at an articulation (3), catch means (4, 5) for latching the cover (2) and the base (1) on an edge opposite the articulation (3), a thumb piece (6) for freeing said catch means (4, 5), and an elastically deformable block (13) buttressed between the base (1) and the cover (2) and disposed adjacent to and abutting the articulation so as to be prestressed during closing of the cover, said block (13) being of a single piece with the cover (2) to which said block (13) is connected by an elastically deformable curved arm (19).

4. A case according to claim 3, wherein said block (13) is of rubber.

* * * * *